US009431697B2

(12) United States Patent
Yoshino et al.

(10) Patent No.: US 9,431,697 B2
(45) Date of Patent: Aug. 30, 2016

(54) USB CABLE ANTENNA

(75) Inventors: Yoshitaka Yoshino, Tokyo (JP); Satoru Tsuboi, Kanagawa (JP)
(73) Assignee: Sony Corporation, Tokyo (JP)

( * ) Notice: Subject to any disclaimer, the term of this patent is extended or adjusted under 35 U.S.C. 154(b) by 324 days.
(21) Appl. No.: 14/117,679
(22) PCT Filed: Apr. 11, 2012
(86) PCT No.: PCT/JP2012/059885
§ 371 (c)(1),
(2), (4) Date: Nov. 14, 2013
(87) PCT Pub. No.: WO2012/157377
PCT Pub. Date: Nov. 22, 2012
(65) Prior Publication Data
US 2014/0184469 A1 Jul. 3, 2014
(30) Foreign Application Priority Data
May 18, 2011 (JP) ..... 2011-111163
(51) Int. Cl.
*H01Q 1/50* (2006.01)
*H01Q 1/46* (2006.01)
*H01Q 1/22* (2006.01)
*H01Q 1/44* (2006.01)
(52) U.S. Cl.
CPC ..... *H01Q 1/50* (2013.01); *H01Q 1/2275* (2013.01); *H01Q 1/44* (2013.01); *H01Q 1/46* (2013.01)
(58) Field of Classification Search
CPC ..... H01Q 1/46; H01Q 2/2275
USPC ..... 343/906, 790, 791, 792
See application file for complete search history.

(56) References Cited

U.S. PATENT DOCUMENTS

| | | | | |
|---|---|---|---|---|
| 2012/0189068 | A1* | 7/2012 | Korner | H01Q 1/44 375/259 |
| 2014/0062811 | A1* | 3/2014 | Seol | H01Q 1/46 343/720 |
| 2015/0200464 | A1* | 7/2015 | Yoshino | H01Q 1/46 343/841 |

FOREIGN PATENT DOCUMENTS

| | | |
|---|---|---|
| CN | 101841343 | 9/2010 |
| CN | 201654774 | 11/2010 |
| EP | 2230718 | 9/2010 |
| JP | 2008-141588 | 6/2008 |
| JP | 2010-068168 | 3/2010 |
| JP | 2010-157991 | 7/2010 |
| JP | 2010-219904 | 9/2010 |
| KR | 101003578 | 12/2010 |
| WO | 2008/068311 | 6/2008 |

OTHER PUBLICATIONS

Notification of the First Office Action issued in connection with Chinese Patent Application No. 2012101476035, dated May 7, 2015. (14 pages).
Extended European Search Report issued in connection with European Patent Application No. 12786593.9, dated Jan. 21, 2015. (9 pages).
Notification of Reason for Refusal issued in connection with Japanese Patent Application No. 2011-111163, dated Feb. 3, 2015. (6 pages).
Office Action issued in EP Application 12786593.9 mailed Feb. 17, 2016 (7 pages).
Office Action issued in CN Application 2012101476035 mailed Jan. 14, 2016 (15 pages).

* cited by examiner

*Primary Examiner* — Hoanganh Le
(74) *Attorney, Agent, or Firm* — K&L Gates LLP

(57) ABSTRACT

There is provided a USB cable antenna which also uses a USB cable as an antenna that receives a high-frequency signal in a desired band, by connecting a metal shield of the USB cable to an ID terminal of a USB connector connected to the USB cable of a predetermined length connected to an information terminal device, connecting a high-frequency cutoff element having a high impedance for the high-frequency signal in the desired band to both ends of a power supply line and a ground line of the USB cable, and connecting a common mode choke having the high impedance for the high-frequency signal in the desired band to both ends of a transmission line of a differential signal of the USB cable.

6 Claims, 10 Drawing Sheets

(A)

(B)

(A)

(B)

(A)

(B)

USB CABLE ANTENNA

CROSS REFERENCES TO RELATED APPLICATIONS

The present application is a national stage of International Application No. PCT/JP2012/059885 filed on Apr. 11, 2012 and claims priority to Japanese Patent Application No. 2011-111163 filed on May 18, 2011, the disclosure of which is incorporated herein by reference.

BACKGROUND

The present disclosure relates to a USB cable antenna obtained by extending the function of a USB (Universal Serial Bus) cable used for input/output of an information terminal device.

To receive TV broadcasting by an information terminal device such as a mobile phone, one of the method of providing a dedicated receiving antenna inside the information terminal device and the method of capturing antenna input from an earphone terminal to listen to an audio signal is generally used.

There is also a desire to receive TV broadcasting in a room in which there is no antenna receptacle for TV broadcasting such as a kitchen in the home. In such a case, using a power transmission cable as an antenna for TV broadcasting is proposed (see, for example, Patent Literature 1).

According to the technology described in Patent Literature 1, the distance between an inductor for high-frequency cutoff provided on the side of a power supply circuit of a power transmission cable and an inductor for high-frequency cutoff provided on the side of a mobile terminal is set to an integral multiple of the ¼ wavelength of the carrier frequency of received TV broadcasting or the like. Accordingly, TV broadcasting or the like in a wide frequency band can be received.

Also, a receiving apparatus capable of obtaining sufficient antenna characteristics even if a connector is shared when a cable used as an antenna is caused to transmit another signal whose frequency overlaps is proposed by the present inventors (see Patent Literature 2).

CITATION LIST

Patent Literature

Patent Literature 1: JP 2010-157991A
Patent Literature 2: JP 2010-219904A

SUMMARY

Technical Problem

Under such circumstances, there is as much need to desire to listen to FM radio or view TV on an information terminal device as in the past. However, with an increasingly thinner and smaller size of information terminal devices in recent years, there is a shortage of space in which many connectors are arranged.

Thus, if a USB cable used for signal transmission and power supply of all information terminal devices can be used as an antenna to receive a radio wave of television broadcasting or the like, the effect thereof is powerful.

An object of the present disclosure is to provide a USB cable antenna capable of receiving a radio wave of FM radio or TV by using a USB cable connected to a USB terminal of an information terminal device and provided with an antenna function of a high-frequency signal.

Solution to Problem

To solve the above issues, according to an embodiment of the present disclosure, there is provided a USB cable antenna which also uses a USB cable as an antenna that receives a high-frequency signal in a desired band, by connecting a metal shield of the USB cable to an ID terminal of a USB connector connected to the USB cable of a predetermined length connected to an information terminal device, connecting a high-frequency cutoff element having a high impedance for the high-frequency signal in the desired band to both ends of a power supply line and a ground line of the USB cable, and connecting a common mode choke having the high impedance for the high-frequency signal in the desired band to both ends of a transmission line of a differential signal of the USB cable.

The high-frequency signal in the desired band received by the antenna is a signal of one or a plurality of bands of a FM band, a VHF band, and a UHF band.

Advantageous Effects of Invention

According to a USB cable antenna in the present disclosure, a USB cable necessary for connecting an information terminal device and a host computer can be used as a high-frequency antenna to receive television broadcasting or the like and therefore, there is no need to provide a built-in antenna on the side of the information terminal device. In addition, there is no need to provide a dedicated connector to connect a receiving antenna of television broadcasting or the like on the side of the information terminal device and therefore, further miniaturization and slimming down of the information terminal device can be realized.

Additional features and advantages are described herein, and will be apparent from the following Detailed Description and the figures.

DETAILED DESCRIPTION

Figure 1:
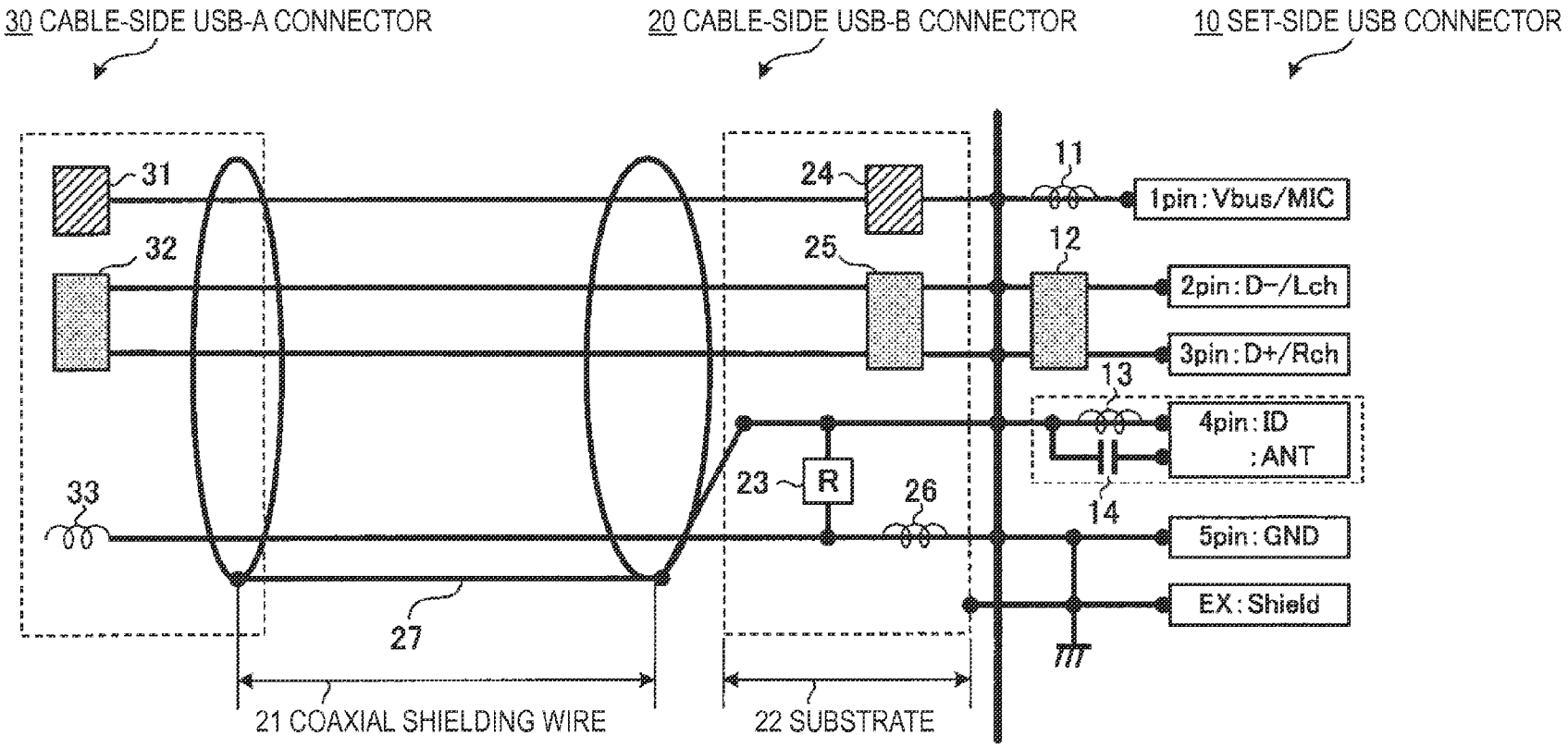
FIG. 1 is a schematic diagram showing an embodiment of a USB cable antenna according to the present disclosure.

As described above, with further slimming down and miniaturization of recent information terminal devices, it is becoming more difficult to secure a space to provide an antenna needed to receive a radio wave of TV broadcasting on the side of the information terminal device or a special connector connected to an external antenna. For example, some earphone antennas have been proposed by inventors and the like as an antenna to receive a radio wave of TV broadcasting. However, the size of diameter of a terminal for earphone needed for the earphone antenna is also an obstacle to further slim down the information terminal device.

Thus, some thin information terminal devices in recent years are provided with only a USB terminal without having any earphone terminal Such information terminal devices are charged from a host computer and various signals are transmitted between the host computer and the information terminal devices by using the USB cable.

To solve the above problem, the inventors focused on a USB terminal mounted on many information terminal devices and a USB cable connected thereto and attempted various ideas and experiments by considering whether the USB cable can be used as a receiving antenna of television broadcasting or the like. As a result, as will be described below, the inventors devised a method of using a USB cable as an antenna capable of receiving a radio wave of television broadcasting or the like.

An embodiment (hereinafter, called the "present example") of a USB cable antenna according to the present disclosure will be described below with reference to FIGS. 1 to 10 and the description will be provided in the order shown below:

1. Schematic configuration of a USB cable antenna
2. Concrete example of the USB cable antenna
3. Verification of maintenance of the USB cable function of the USB cable antenna
4. Frequency-gain characteristics of the USB cable antenna
5. High-frequency impedance characteristics of FB inserted into a power supply line of the USB cable antenna
6. Concrete example of the USB-A connector to which the USB cable connector is connected
7. Characteristics comparison when an AC adapter is connected to the USB cable antenna <Schematic Configuration of a USB Cable Antenna>

FIG. 1 is a diagram illustrating the configuration of a USB cable antenna in the present example and the operation principle thereof. As shown in FIG. 1, a female USB connector for USB cable connection is provided on the side of an information terminal device (hereinafter, also called a "set"). The USB connector provided on the set side will be called a "set-side USB connector 10" below.

Then, a male B-type USB connector is attached to one end of a coaxial shielding wire of an appropriate length (for example, about 95 to 115 cm). Hereinafter, the male USB connector will be called a "cable-side USB-B connector 20" to distinguish from the set-side USB connector 10.

A male A-type USB connector is attached to the other end of the USB cable. The USB connector will be called a "cable-side USB-A connector 30". The USB connector is a standard-type USB connector and is connected to the host computer side.

First, the set-side USB connector 10 will be described with reference to FIG. 1 and then a concrete connecting relation to the USB cable antenna in the present example will be described.

In general, the set-side USB connector 10 (female type) and the cable-side USB-B connector 20 (male type) each have five connection pins and a shielding terminal. A μUSB-B connector is normally used as the set-side USB connector 10 and the cable-side USB-B connector 20. In contrast, the cable-side USB-A connector 30 connected to the host computer side is a standard-type A-type USB connector capable of supplying power.

In recent years, however, the distinction between the A type and the B type has become blurry and an A-type or AB-type (USB connector used for both of the host side and the set side) μUSB connector may be used as the set-type USB connector 10.

As shown in FIG. 1, 1-pin of the set-side USB connector 10 is a Vbus/MIC terminal for power supply and power is fed from the side of the host computer (not shown) to the information terminal device (set) via 1-pin and also a voltage is supplied to an earphone microphone or the like connected to the set. A ferrite bead 11 for high-frequency cutoff is connected in series to a line to which 1-pin of the set-side USB connector 10 is connected. Hereinafter, the ferrite bead may be abbreviated simply as "FB".

2-pin and 3-pin of the set-side USB connector 10 are terminals of a signal line of differential signals to be transmitted and received through the USB cable, and when an audio signal is input into these terminals, 2-pin (D− terminal) functions as a terminal of an L channel and 3-pin (D+ terminal) functions as a terminal of an R channel. A common mode choke 12 is connected to a line to which 2-pin and 3-pin used for differential are connected. Then, high-frequency signals are cut off and only an audio signal is passed by the common mode choke 12. In the description that follows, the high-frequency signal may also be called an "RF signal" or "antenna signal".

4-pin of the set-side USB-B connector 10 is an ID terminal (ID is an abbreviation of Identification, also called an "identification terminal") to identify the type of an inserted plug and the use to which the plug is applied.

In the set-side USB connector 10 in the present example, as shown in FIG. 1, 4-pin used as the ID terminal is used as an antenna terminal to receive TV broadcasting or the like. Thus, a capacitor 14 of about 1000 pF is connected in series to a line to which 4-pin is connected and an antenna signal supplied to 4-pin via the capacitor 14 is supplied to a tuner circuit (not shown) in the set.

4-pin of the set-side USB-B connector 10 is a pin naturally used as a normal ID terminal. High-frequency signals of television and the like can be an obstacle in realizing the function as a normal ID terminal and an FB 13 as a high-frequency cutoff element is connected in parallel with the capacitor 14 to the line to which 4-pin is connected to remove such high-frequency signals. Accordingly, an ID signal from which high-frequency antenna signals such as a television signal have been removed is output to an ID identification circuit (not shown) on the set side.

Incidentally, 5-pin of the set-side USB connector 10 is a ground terminal for grounding and a line to which 5-pin is connected is connected and grounded to each of external shields of the cable-side USB-B connector 20 and set described later.

As described above, a substrate 22 is provided at one end of a coaxial shielding wire 21 in the USB cable antenna shown in FIG. 1 and the male cable-side USB-B connector 20 is connected to the substrate 22. Like the set-side USB connector 10, a μUSB connector is used normally for the cable-side USB-B connector 20, but in addition, a μUSB connector of the A type or AB type may also be used.

A resistor 23 is connected between the ID terminal (4-pin) of the cable-side USB-B connector 20 and the ground line and based on the value of the resistor 23, the USB connector of which use is connected and how the USB cable is used can be known.

In addition, a metal shield 27 of the coaxial shielding wire 21 is connected to the ID terminal and the metal shield 27 functions as a monopole antenna described later.

Also, an FB 24 as an element to cut off high-frequency signals is connected to a power supply line to which 1-pin of the cable-side USB-B connector 20 shown in FIG. 1 is connected. A common mode choke 25 is connected to 2-pin (D− terminal) and 3-pin (D+ terminal) that transmit a differential signal. Like the common mode choke 12 provided in the set-side USB connector 10, the common mode choke 25 also has a function to cut off high-frequency waves. Similarly, an FB 26 as an element to cut off high-frequency waves is connected to the ground line to which 5-pin of the cable-side USB-B connector 20.

As shown in FIG. 1, the standard A-type cable-side USB-A connector 30 is connected to the other end of the coaxial shielding wire 21. An FB 31 for cutting off high-frequency waves is connected to 1-pin of the cable-side USB-A connector 30. A common mode choke 32 is connected to the signal line to which 2-pin and 3-pin to which a differential signal is supplied are connected. Further, an FB 33 for cutting off high-frequency waves is connected to the ground line to which 5-pin is connected. To satisfy both of the ordinary USB cable signal function and the antenna function of a high-frequency signal like a television signal, the DC resistance of the FB 33 inserted into the ground line is desirably 0.25Ω or less. As the common mode choke 32, for example, a product having 90Ω for high-frequency waves or a product having 120Ω is used.

In the USB cable antenna in the present example, the metal shield 27 as a skin conductor of the coaxial shielding wire 21 is connected to the ID terminal (4-pin) of the cable-side USB-B connector 20. As shown in FIG. 1, the metal shield 27 connected to the ID terminal is a shielding line that is different from the ground line.

The reason why the metal shield 27 is connected to the ID terminal (4-pin) to receive a radio wave like a television signal is as follows:

The transfer clock used for signal transfer in USB 2.0 is fixed to 480 Mbps. A signal of the transfer clock operates between the differential signal line and the ground line and thus, if the ground line of a USB cable is used as an antenna of a television signal, the antenna is in a state in which the clock signal of 480 Mbps of USB is superimposed on a RF signal of television or the like. The so-called "fogging" occurs.

Therefore, when a USB cable is used as an antenna for television broadcasting, the ground line cannot be used as an antenna. As a result of experiment, the inventors found that the problem can be solved by using the metal shield 27 that is different from the ground line.

Incidentally, the clock of 480 Mbps in USB 2.0 corresponds to a frequency of 240 MHz and thus, the band particularly affected adversely is the VHF-H (high) band.

When the male cable-side USB-B connector 20 is inserted into the female set-side USB-B connector 10, it is necessary to discriminate (detect) whether an antenna capable of receiving a radio wave of television broadcasting or the like is inserted. Thus, the resistor 23 is inserted between the line to which the ID terminal (4-pin) of the cable-side USB-B connector 20 and the ground line to which 5-pin is connected. The value of resistance of the resistor 23 is different depending on the type of the cable-side USB-B connector 20, in other words, what the cable-side USB-B connector 20 is used for.

Therefore, by detecting the value (value of resistance) of the resistor 23, whether a USB connector having an antenna function of television broadcasting or the like is inserted can be detected.

The value of resistance of the resistor 23 is normally high impedance (hundreds of kΩ) and thus, the ID line and the ground line are open at high frequencies and antenna characteristics are not affected from the ground line to the ID line. However, to be noted is a case of high-frequency connection by a capacitor of connection capacity or the like after passing FB 64 to 67 connected to each line other than the ID line. In such a case, a high-frequency current flows to each terminal, causing the degradation of antenna characteristics.

<Concrete Example of the USB Cable Antenna>

FIGS. 2(A) to 2(D) show samples of the above USB cable antenna. FIG. 2(A) is a plan view when viewed from above, FIG. 2(B) is a sectional view of the B-type cable-side USB-B connector 20 (here, a μUSB-B connector), FIG. 2(C) is a sectional view of the A-type cable-side USB-A connector 30 (here, a standard-type USB-A connector), and FIG. 2(D) is a front view. The dimension of each figure is based on the standard of the USB connector and μUSB connector. In FIGS. 2(A) to 2(D), the same reference signs are attached to the same members as those in FIG. 1.

Figure 2:
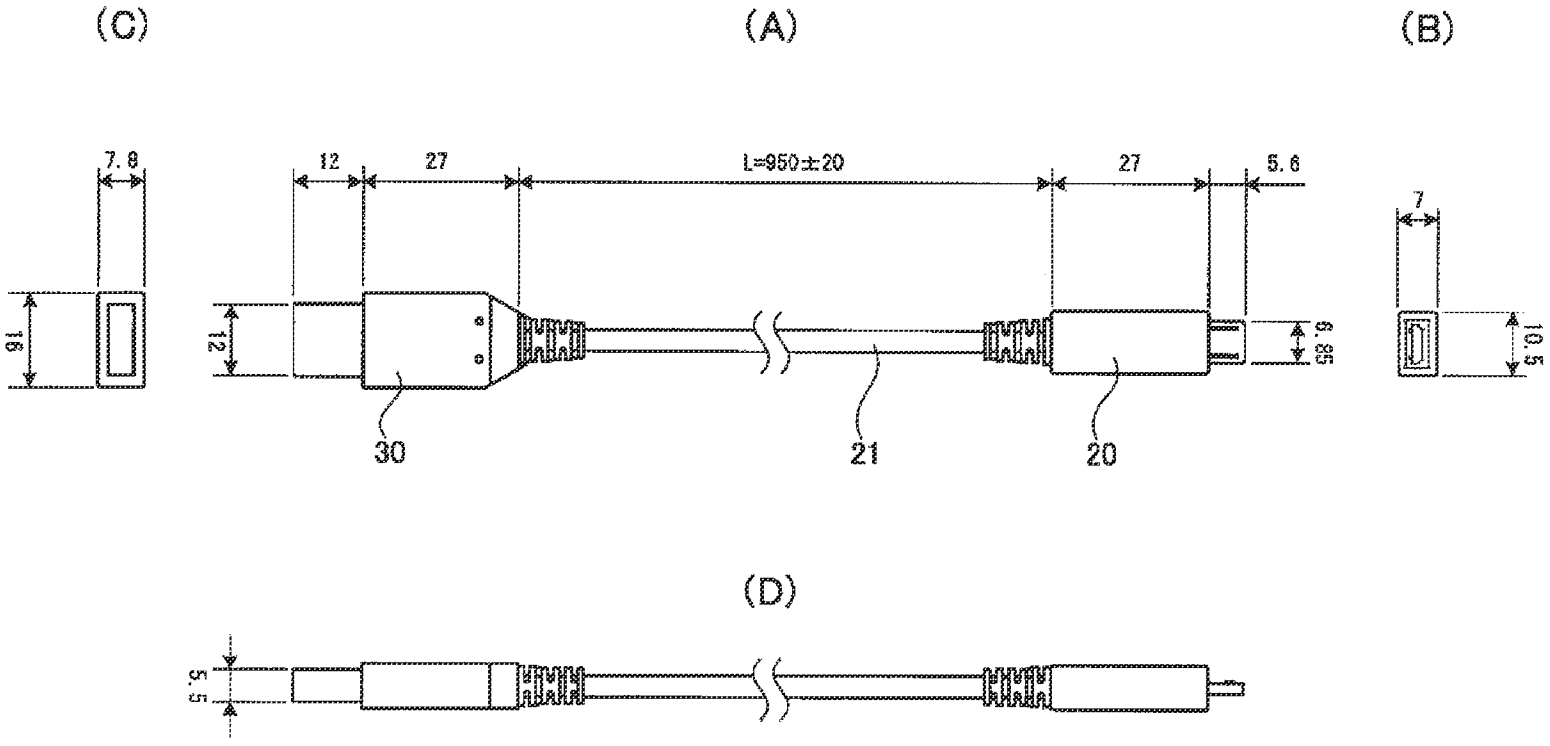
FIGS. 2(A) to 2(D) are diagrams showing concrete examples of the USB cable antenna having an A-type USB connector connected to one end thereof and a B-type USB connector connected to the other end thereof.
Figure 3:
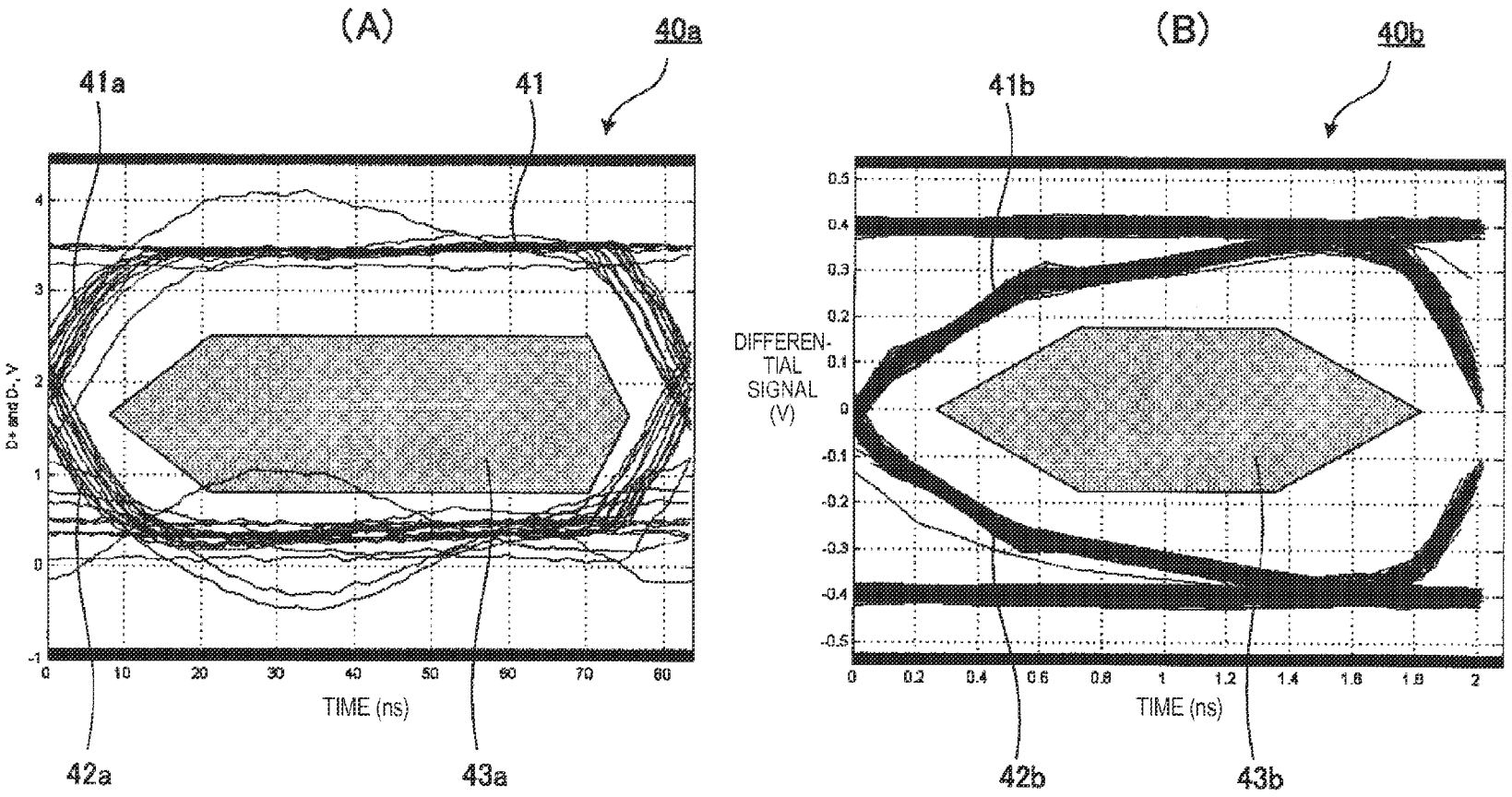
FIGS. 3(A) and 3(B) are diagrams showing eye patterns when compliance tests of a differential signal of USB 1.1 and USB 2.0 are performed by setting the DC resistance of a ferrite bead (FB) inserted into a ground line to 1Ω and the high-frequency resistance of a common mode choke inserted into a differential signal line to 90Ω (100 MHz) in the USB cable antenna shown in FIG. 2.
Figure 4:
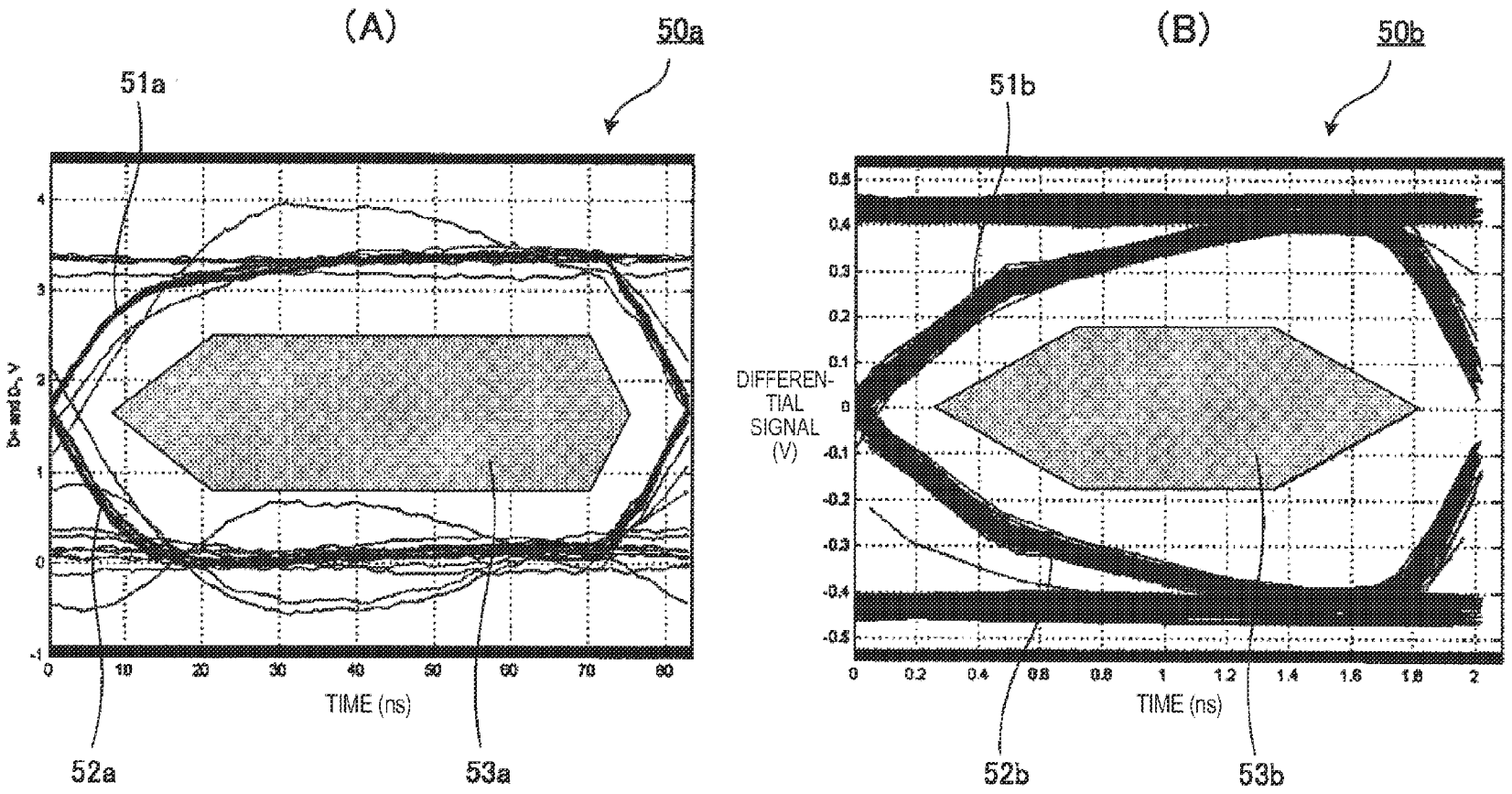
FIGS. 4(A) and 4(B) are diagrams showing eye patterns when compliance tests of a differential signal of USB 1.1 and USB 2.0 are performed by setting the DC resistance of a ferrite bead (FB) inserted into a ground line to 0.05Ω and the high-frequency resistance of a common mode choke inserted into a differential signal line to 90Ω (100 MHz) in the USB cable antenna shown in FIG. 2.
Figure 5:
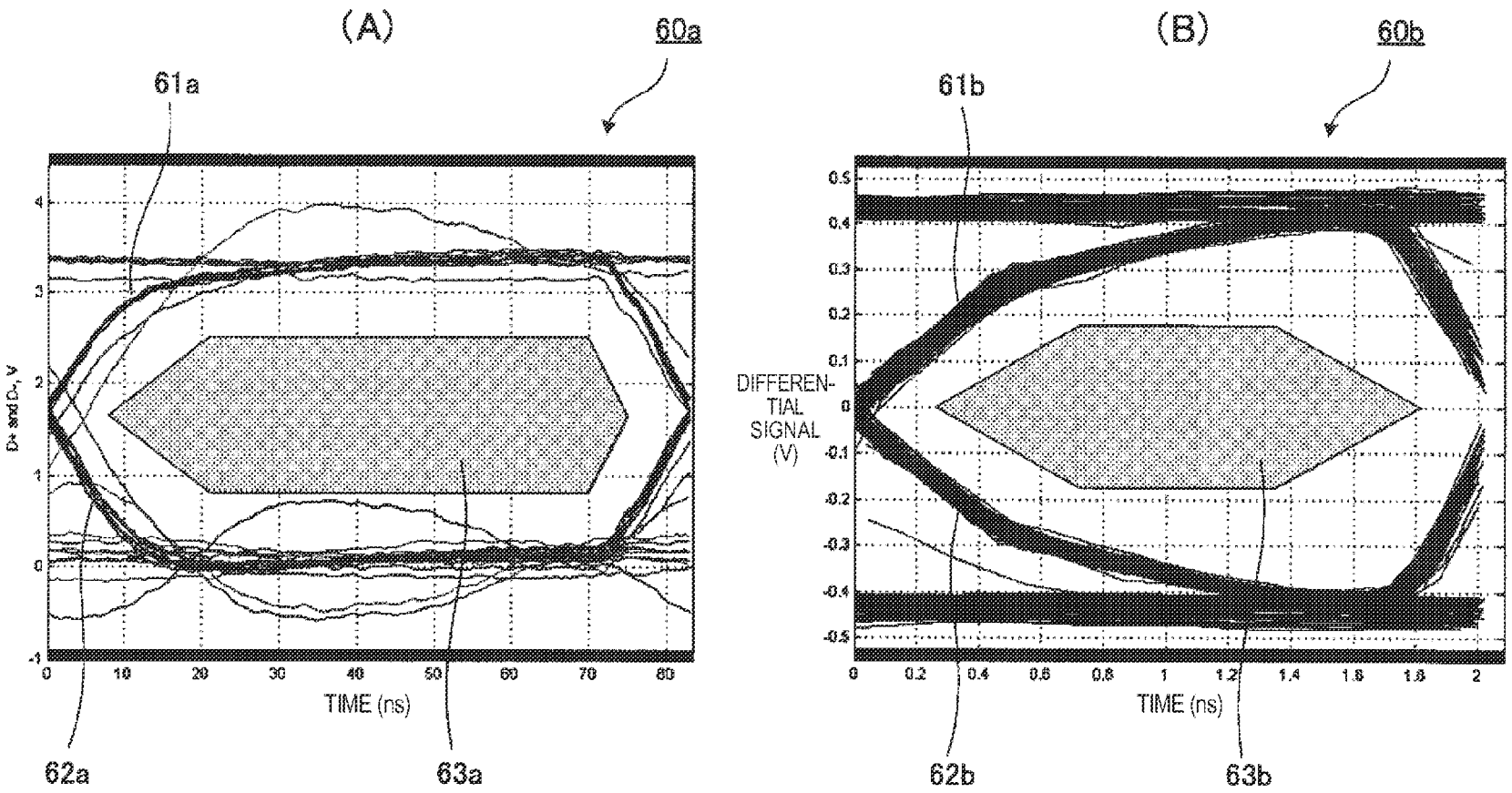
FIGS. 5(A) and 5(B) are diagrams showing eye patterns when compliance tests of a differential signal of USB 1.1 and USB 2.0 are performed by setting the DC resistance of a ferrite bead (FB) inserted into a ground line to 0.05Ω and the high-frequency resistance of a common mode choke inserted into a differential signal line to 120Ω (100 MHz) in the USB cable antenna shown in FIG. 2.
Figure 6:
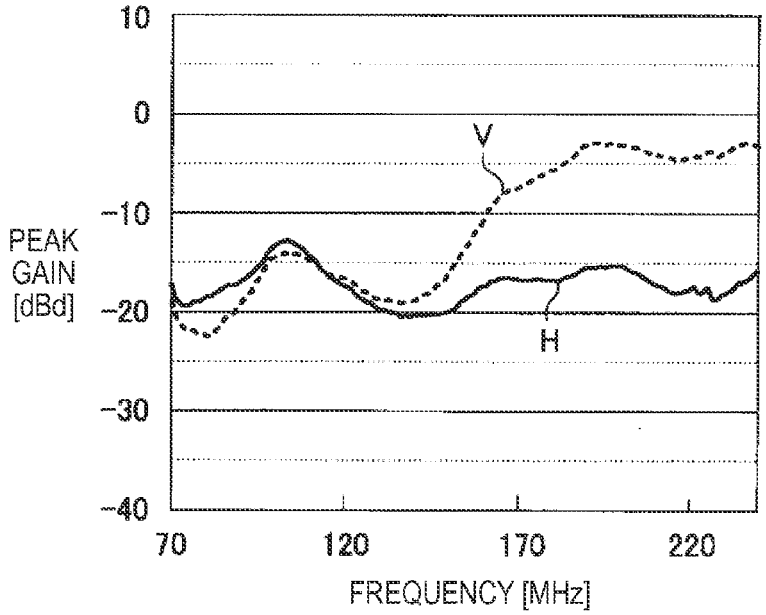
FIGS. 6(A) and 6(B) are diagrams showing frequency-gain characteristics when TV waves of the VHF band (A) and the UHF band (B) are received using the USB cable antenna shown in FIG. 2.
Figure 6:
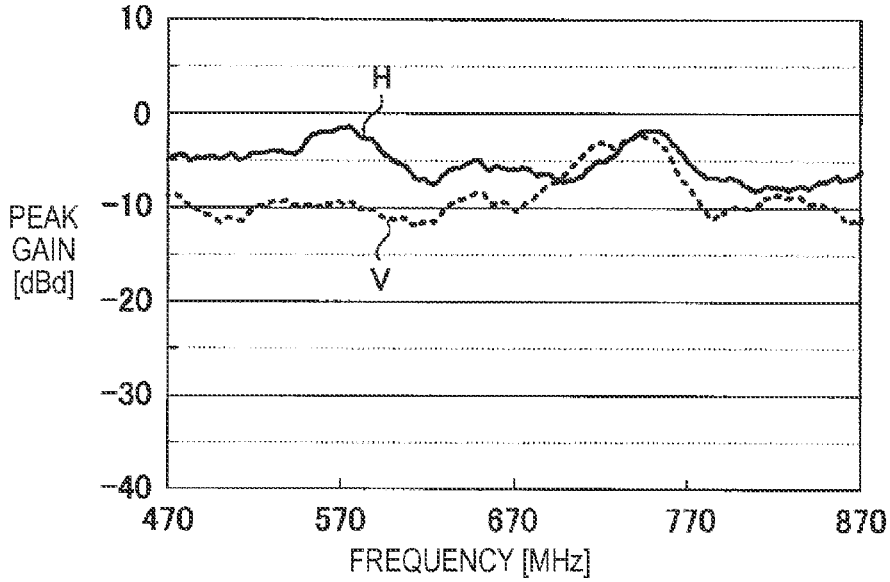

As shown in FIG. 2, the narrower side of the cable-side USB-B connector 20 has a width of 7 mm, which is suitable as a connection terminal of a mobile phone or the like proceeding toward further slimming down in the future. On the other hand, the narrower side in the section of the cable-side USB-A connector 30 connected to the host computer has a width of 7.8 mm.

In the Japanese television broadcasting, the VHF band of 90 to 108 MHz (1 to 3 ch) and 170 to 222 MHz (4 to 12 ch) and the UHF band of 470 to 770 MHz (13 to 62 ch) are used. Incidentally, the VHF band may be divided to call 90 to 108 MHz as the VHF-L (low) band and 170 to 222 MHz as the VHF-H (high) band. In the USB cable antenna in the present example, the length of the cable is adjusted to 115 cm, which is about ¾ the wavelength (¾·λ) of 200 MHz so as to be able of receive both of the VHF-H (high) band and the UHF band. Incidentally, UHF is received by high-frequency excitation.

<Verification of Maintenance of the USB Cable Function of the USB Cable Antenna>

When a television signal is received by connecting the cable-side USB-B connector 20 of the above USB cable antenna in the present example to the set-side USB connector 10, whether the original USB function is maintained is important. Thus, a compliance test to verify whether the function of USB is degraded in the USB cable antenna of the present example was performed. FIGS. 3(A) to 5(B) are diagrams showing eye patterns of the compliance test to check whether the USB cable antenna in the present example satisfies two standards of USB 1.1 and USB 2.0.

FIGS. 3(A) and 3(B) shows results of the compliance test of USB by setting the DC resistance of the FB 26, 33 of the ground line to 1Ω and the common mode chokes 25, 32 connected to the D− line and D+ line that transmit a differential signal to 90Ω (100 MHz) in the USB cable antenna shown in FIG. 2. FIG. 3(A) shows an eye pattern 40*a* of the compliance test of USB 1.1 and FIG. 3(B) shows an eye pattern 40*b* of the compliance test of USB 2.0.

The eye pattern is also called an eye diagram or an eye opening ratio and is created by sampling and superimposing the transition of a signal waveform many times and graphically showing the result. The horizontal axis represents the time and the vertical axis represents the voltage. If the eye pattern is viewed and a plurality of signal waveforms is superimposed in the same position (timing and voltage), the waveform is considered to be a high-quality waveform and conversely, if positions (timing and voltage) of signal waveforms are shifted and signal waveforms overlap with a hexagonal shape (template) in the center, the waveform is considered to be a low-quality waveform. It is also known that a waveform of degraded transmission characteristics has a hexagonal shape (template 43) in the center that is thin and flat and the area thereof is small. The test is called an eye pattern test (or an eye diagram test) because the relation between the signal lines and the template is similar to the shape of an open human eye.

The eye pattern 40*a* shows the compliance test result of USB 1.1 when the DC resistance of FB inserted into the ground line is 1Ω and the impedance of the common mode choke at 100 MHz is 90Ω. In the compliance test of USB 1.1, differential signals 41*a*, 42*a* passing through the signal lines of D+=0.35 V and D−=−0.35 V and having a phase difference of 180° are simultaneously displayed. Viewing the displayed eye pattern 40*a* shows that a portion of waveforms of the differential signal 41*a* or 42*a* overlaps with a template 43*a* in the hexagonal shape. From the above result, the USB cable antenna in the present example does not satisfy the function of USB 1.1, that is, the USB cable antenna failed (NG) in the compliance test of USB 1.1.

On the other hand, the eye pattern 40*b* in FIG. 3(B) shows the compliance test result of USB 2.0 when the DC resistance of FB inserted into the ground line is 1Ω and the impedance of the common mode choke at 100 MHz is 90Ω. In the compliance test of USB 2.0, differential signals 41*b*, 42*b* passing through the signal lines of D+=0.4 V and D−=−0.4 V and having a phase difference of 180° are simultaneously displayed. Viewing FIG. 3(B) shows that differential signals 41, 42 propagated through the line to which 2-pin and 3-pin are connected are positioned between parallel lines of D+=0.4 V, D−=−0.4 V and further, the hexagonal template 43 is positioned inside a region surrounded by these two differential signals 41, 42.

That is, as far as USB 2.0 is concerned, FIG. 3(B) shows that even if 4-pin of the USB connector to which a cable is connected is used also as an antenna input terminal, the eye pattern test is passed, in other words, standards of USB 2.0 are satisfied. In the standards of USB 2.0, the clock of transmission of a USB signal is 480 Mbps and belongs to the VHF band (240 MHz) as a frequency band.

FIGS. 4(A) and 4(B) show eye patterns 50*a*, 50*b* showing results of performing the compliance test of differential signals of USB 1.1 and USB 2.0 using the USB cable antenna shown in FIG. 2. FIGS. 4(A) and 4(B) are different from FIGS. 3(A) and 3(B) in that the DC resistance of the FB 26, 33 inserted into the ground line is set to 0.05Ω. The impedance of the common mode chokes 25, 32 at 100 MHz remains 90Ω.

In the eye pattern 50*a*, as shown in FIG. 4(A), all differential signal lines 51*a*, 52*a* of D+ and D− surround an eye pattern 53*a*. Also in the eye pattern 50*b* shown in FIG. 4(B), differential signal lines 51*b*, 52*b* of differential signal lines D+ and D− surround an eye pattern 53*b* and do not overlap with each other. The result means that the USB cable antenna passes the compliance tests of USB 1.1 and USB 2.0, that is, the standards of both of USB 1.1 and USB 2.0 are satisfied.

FIGS. 5(A) and 5(B) also show eye pattern diagrams showing compliance test results of the USB cable antenna shown in FIG. 2. FIGS. 5(A) and 5(B) are different from FIGS. 4(A) and 4(B) in that a product whose impedance at 100 MHz is 120Ω is used as the common mode choke 25, 32 inserted into the differential signal lines. The DC resistance of the FB 26, 33 of the ground line remains the same resistance of 0.05Ω as in FIG. 4.

In the compliance test of USB 1.1 shown in FIG. 5(A), all differential signal lines 61*a*, 62*a* of D+ and D− surround an eye pattern 63*a* and also in the compliance test of USB 2.0 shown in FIG. 5(B), all differential signal lines 61*b*, 62*b* of D+ and D− are similarly outside an eye pattern 63*b* and do not overlap with each other.

From the above results, it is verified that a USB cable antenna satisfying both standards of USB 1.1 and USB 2.0 can be obtained by appropriately selecting the DC resistance of the FB 26, 33 inserted into the ground line and the impedance of the common mode chokes 25, 32 inserted into the differential signal lines.

<Frequency-Gain Characteristics of the USB Cable Antenna>

The USB cable antenna in the present example shown in FIGS. 1 and 2 constitutes, as described above, a monopole antenna between the set and the ground (GND). An experiment of receiving radio waves of television broadcasting in the VHF-H band and the UHF band using the USB cable antenna was conducted. That is, a sample of the USB cable antenna shown in FIG. 2 is connected to the female set-side USB connector 10 (see FIG. 1) to investigate transmission characteristics of a high-frequency signal such as a television wave.

Table 1 and FIG. 6(A) show frequency-gain characteristics when television broadcasting in the VHF band is received by the USB cable antenna shown in FIG. 1.

In the VHF band of 170 to 220 MHz, as shown in Table 1 and FIG. 6(A), gain characteristics of −5 dB (−4.04 dB at 210 MHz) or more are exhibited in vertical polarization and gain characteristics of −20 dB (−17.24 dB at 210 MHz) or more are exhibited in horizontal polarization (see Table 1).

TABLE 1

| | Frequency [MHz] | | | | | | | |
|---|---|---|---|---|---|---|---|---|
| | 188.5 | 192.5 | 194.5 | 198 | 204 | 210 | 216 | 222 |
| | Vertical polarization | | | | | | | |
| Peak [dBd] | −3.27 | −2.89 | −2.97 | −3.10 | −3.40 | −4.04 | −4.68 | −4.24 |
| | Horizontal polarization | | | | | | | |
| Peak [dBd] | −15.67 | −15.49 | −15.37 | −15.30 | −16.00 | −17.24 | −18.08 | −17.90 |

Table 2 and FIG. 6(B) show frequency-gain characteristics when television broadcasting in the UHF band is received and in the UHF band of 470 to 870 MHz, as shown in FIG. 6(B), gain characteristics of −12 dB or more are exhibited in vertical polarization and gain characteristics of −8 dB or more are exhibited in horizontal polarization.

These results show that the USB cable antenna shown in FIGS. 1 and 2 sufficiently fulfills the function as an antenna of the VHF-H band and the UHF band of television broadcasting. These results mean that the USB cable antenna is also applicable as an antenna for multimedia broadcasting planned to be broadcast using the VHF band.

TABLE 2

| | Frequency [MHz] | | | | | | | |
|---|---|---|---|---|---|---|---|---|
| | 470 | 520 | 570 | 620 | 670 | 720 | 770 | 906 |
| | Vertical polarization | | | | | | | |
| Peak [dBd] | −8.80 | −10.09 | −9.53 | −11.61 | −10.36 | −3.18 | −7.85 | −3.98 |
| | Horizontal polarization | | | | | | | |
| Peak [dBd] | −5.00 | −4.29 | −1.64 | −7.34 | −5.96 | −5.15 | −5.25 | −2.58 |

<High-Frequency Impedance Characteristics of FB Inserted into a Power Supply Line of the USB Cable Antenna>

Next, the FB 24, 31 connected to a power supply line (Vbus line) shown in FIG. 1 will further be described. In contrast to the FB 26, 33 connected to the ground line, the FB 24, 31 are special ferrite beads (FB) capable of maintaining high-frequency characteristics even if a current flows.

The FB normally used like the FB 26, 33 inserted into the ground line has a magnetic material around a coil and removes a high-frequency current by converting the high-frequency current into heat using a high impedance state at high frequencies, that is, a state of high high-frequency losses. That is, the FB plays the role as a high-frequency signal cutoff element.

The normal FB 26, 33 described above are produced while a coil is inside a magnetic material and thus, the magnetic material is saturated when the current increases. That is, in the normal FB, a closed magnetic circuit is formed and magnetic fluxes are confined and thus, saturation is more likely to be reached when a large current flows. Therefore, it becomes more difficult to maintain original characteristics.

In contrast, the FB 24, 31 provided in the line for power supply to which 1-pin of a USB terminal is connected are produced by taking a case when a large current flows into consideration and an open magnetic circuit is formed by a coil and a magnetic material. Thus, magnetic fluxes are not confined even if a magnetic material is present and therefore, even if a large current flows to the coil, the current is converted into heat only inside the coil and the magnetic material is structured to be less likely to be saturated.

Figure 7:
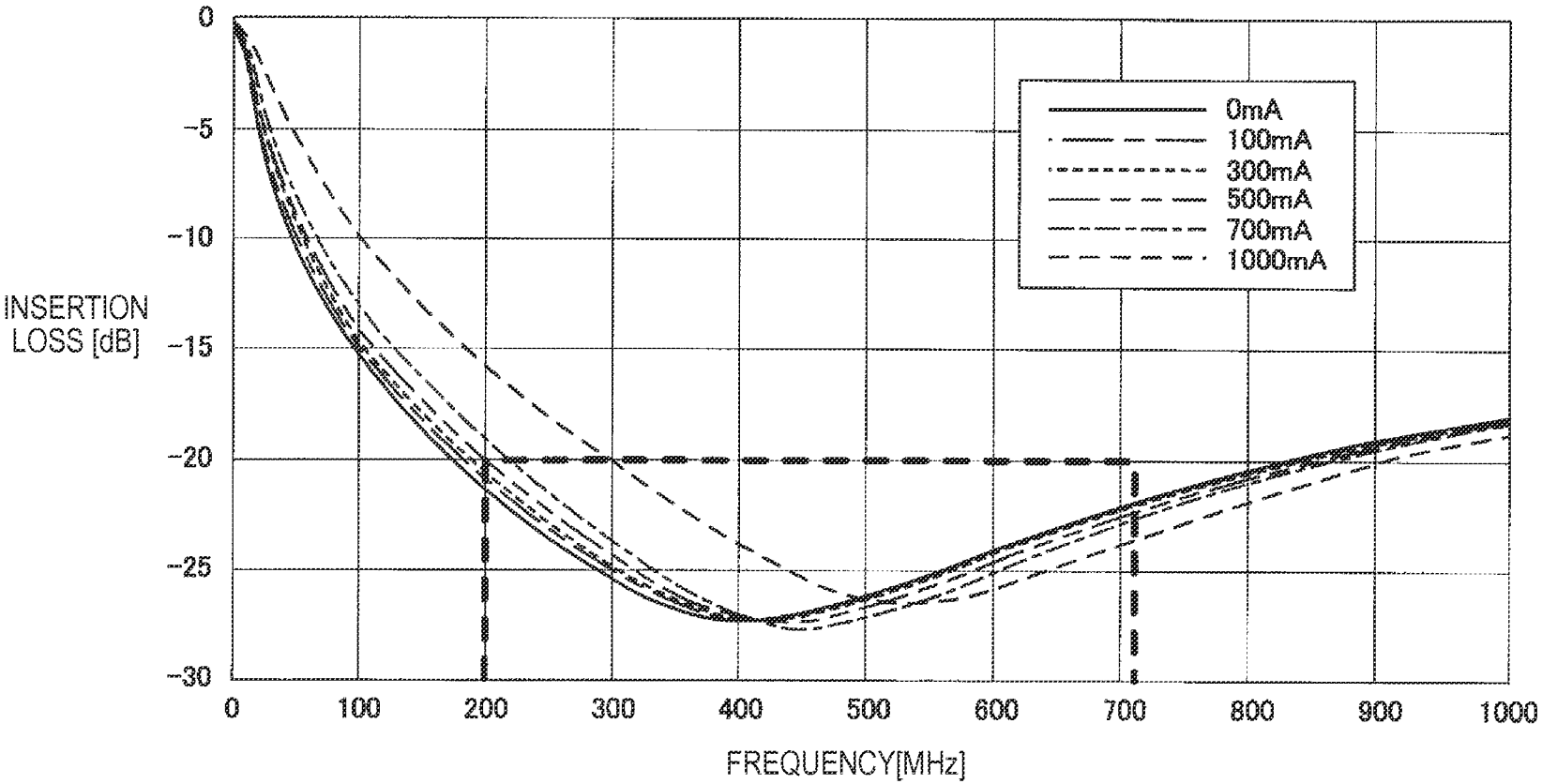
FIG. 7 is a diagram showing the relationship between the frequency and high-frequency impedance when a current is passed to the ferrite bead (FB) provided in a power transmission line of the USB cable antenna.

FIG. 7 shows high-frequency impedance characteristics of the FB 24, 31 when a current is stepwise passed to a line to which the Vbus/MIC terminal (1-pin) of the USB cable antenna is connected.

As is evident from FIG. 7, approximately the same frequency characteristics are exhibited when no current is passed to the line to which 1-pin is connected (0 mA) and when currents are passed (100 mA, 300 mA, 500 mA, 700 mA). However, as shown in FIG. 7, it is verified that a little different frequency characteristics are exhibited when the magnitude of the current is 1 A (1000 mA).

It also turned out that insertion losses are about −20 dB to −27.5 dB in the band of 200 MHz to 700 MHz corresponding to the VHF band to the UHF band of television broadcasting.

Such a level of insertion losses can be considered to be a level allowing reception of the VHF band to the UHF band of television broadcasting.

<Concrete Example of the USB-A Connector to which the USB Cable Connector is Connected>

Next, a concrete example of the USB-A connector to which the USB cable antenna is connected will be described with reference to FIG. 8.

Figure 8:
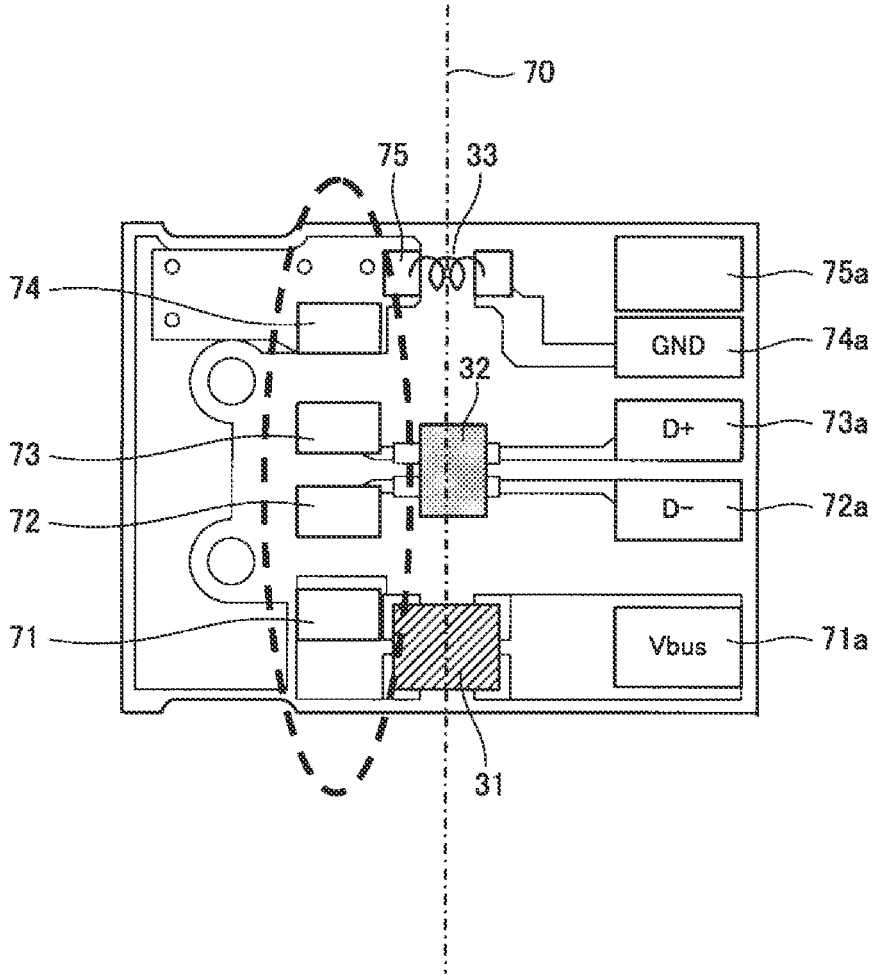
FIG. 8 is a diagram showing a concrete configuration of a USB-A connector to which the USB cable connector is connected.
Figure 9:
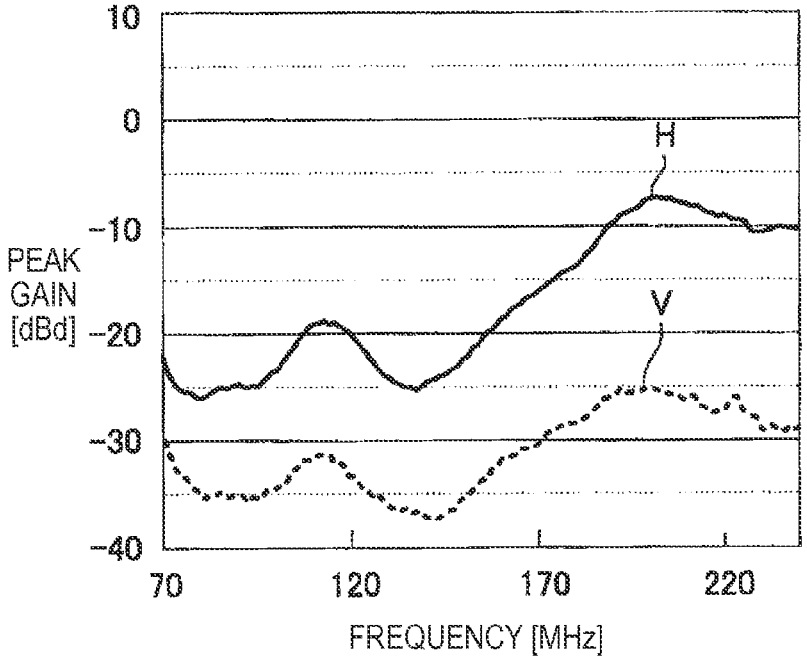
FIG. 9 is a diagram (when a ferrite core is inserted) showing frequency-gain characteristics when (A) no AC adapter is connected to the USB cable antenna and (B) the AC adapter is connected to the USB cable antenna.
Figure 9:
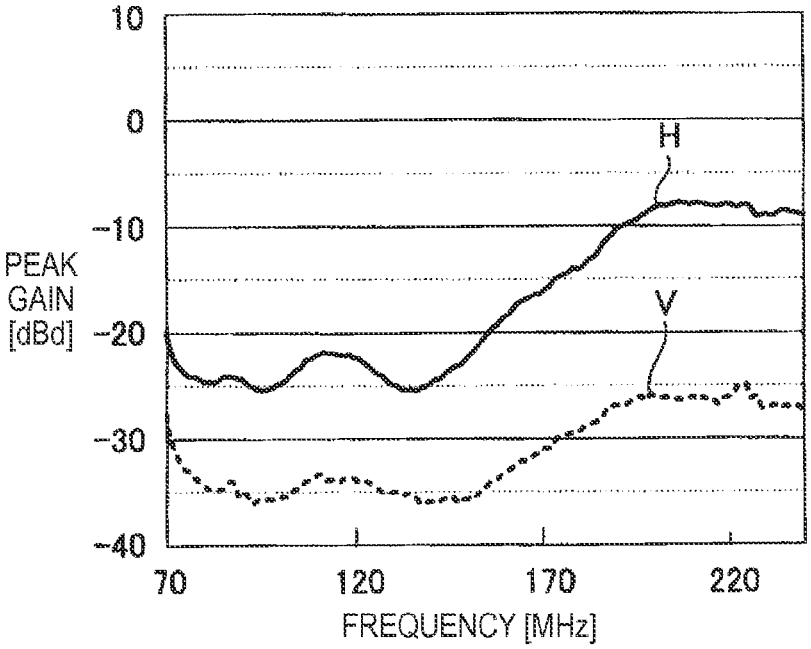
Figure 10:
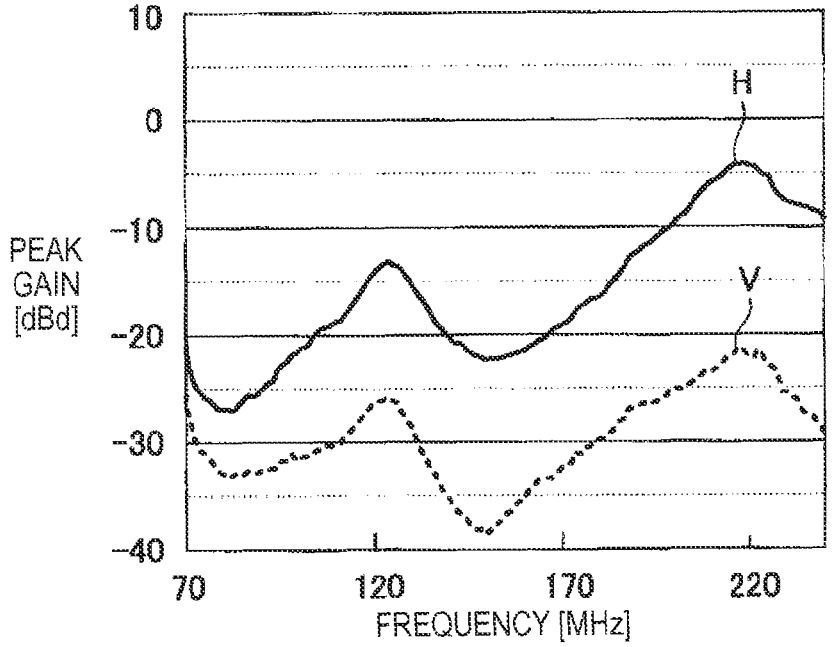
FIG. 10 is a diagram (when a ferrite core is not inserted) showing frequency-gain characteristics when (A) no AC adapter is connected to the USB cable antenna and (B) the AC adapter is connected to the USB cable antenna.
Figure 10:
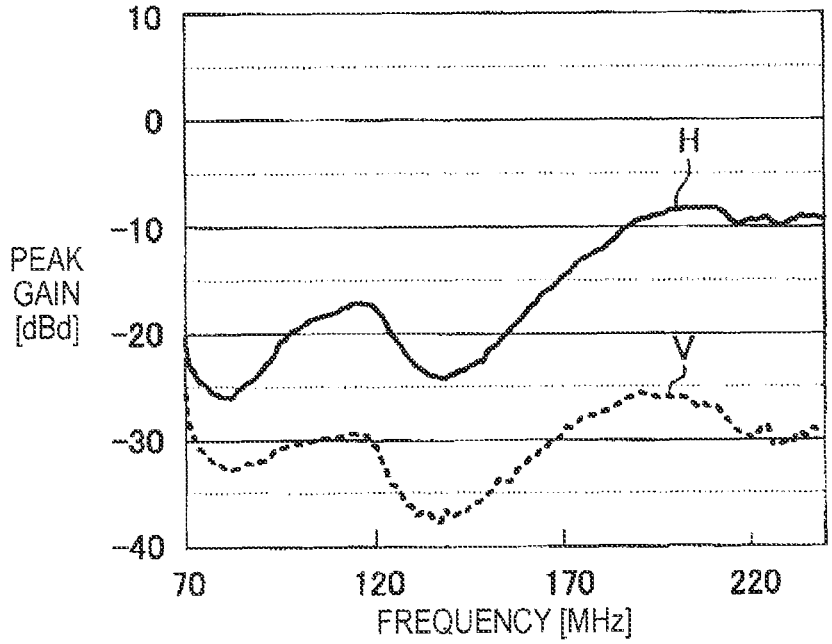

The dotted line in the center of FIG. 8 shows a substrate 70 and the left side of the substrate 70 shows a USB-A plug inserted into the host. The right side of the substrate 70 shows a connector portion to which the USB cable antenna in the present example is connected.

In the USB-A plug on the left side of the substrate 30, socket pins are arranged in a portion surrounded by a thick dotted line. That is, 1-pin 71 to which the power supply line (Vbus) is connected, 2-pin 72 to which the D− line of a differential signal is connected, 3-pin 73 to which similarly the D+ line is connected, and a socket pin of 4-pin 74 as the ID terminal are arranged in parallel from below. 5-pin 75 to which the ground line (GND) is connected is arranged above the 4-pin 74.

The right side of the substrate 70 is a portion to which the USB cable antenna of the present example is connected. 1-pin 71*a* to which a line of Vbus is connected, 2-pin 72*a* and 3-pin 73*a* to which lines of differential signals D−, D+ are connected respectively, and 4-pin 74*a* to which a line of GND is connected are arranged from below. 5-pin 75*a* to which the metal shield 27 shown in FIG. 1 is connected is provided above the 4-pin 74*a*. The metal shield 27 connected to the 5-pin 75*a* fulfills, as described above, the function as an antenna by being connected to 4-pin (ID terminal) of the set-side USB connector 10 (μUSB-B connector) in FIG. 1.

The 1-pin 71*a* on the right side of the substrate 70 is connected to the 1-pin 71 of the USB-A plug on the left side of the substrate 70 via the FB 31 and the 2-pin 72*a* and the 3-pin 73*a* on the right side of the substrate 70 are connected to the 2-pin 72 and the 3-pin 73 of the USB-A plug on the left side of the substrate 70 via the common mode choke 32. The 4-pin 74*a* to which the GND line is connected on the right side of the substrate 70 is connected to the 5-pin 75 as the GND terminal on the left side of the substrate 70.

The 5-pin 75*a* to which the metal shield 27 of the USB cable antenna is connected on the right side of the substrate 70 is not connected to any terminal on the left side of the substrate 70 and is in an open state.

In general, a USB-A connector provided at one end of the USB cable antenna in the present example is connected to the host side including a power unit and so is more likely to be affected by noise generated by the power unit. Thus, in FIG. 8, pins are arranged on a straight line to make respective signal lines parallel so as to be less likely to be affected by noise from the unit. Accordingly, a USB cable antenna having the function as an antenna and less likely to be affected by noise from the power unit can be produced.

<Characteristics Comparison when an AC Adapter is Connected to the USB Cable Antenna>

If a charger (AC adapter) for USB is connected to the tip of a USB-A connector, the USB cable antenna in the present example can receive a television signal while being charged. Thus, an experiment to investigate to which extent frequency-gain characteristics of the USB cable antenna change when an AC adapter is connected to the tip of the USB-A connector and no AC adapter is connected was conducted.

Table 3, Table 4, and FIGS. 9(A) and 9(B) show frequency-gain characteristics in the VHF band of the USB cable antenna in the present example when no AC adapter is connected to the USB-A connector side to which the USB cable antenna is connected (A) and an AC adapter is connected (B). In the examples shown in FIGS. 9(A) and 9(B), a ferrite core (not shown) is arranged near the USB-A plug and the USB antenna cable wound around the ferrite core once or twice before making measurements.

It is clear from FIGS. 9(A) and 9(B) that if the ferrite core is inserted, changes of frequency-gain characteristics are small when the USB-A plug is not connected to the AC adapter (A) and the USB-A plug is connected to the AC adapter (B).

That is, viewing FIGS. 9(A) and 9(B) shows that near 210 MHz used for the USB cable antenna, frequency-gain characteristics hardly change when the USB cable antenna is not connected to the AC adapter in FIG. 9(A) (−26.06 dBd in vertical polarization and −7.84 Bd in horizontal polarization) and the USB cable antenna is connected to the AC adapter in FIG. 9(B) (−25.95 dBd in vertical polarization and −7.75 dBd in horizontal polarization) (see Table 3 and Table 4).

TABLE 3

| | Frequency [MHz] | | | | | | | |
|---|---|---|---|---|---|---|---|---|
| | 188.5 | 192.5 | 194.5 | 198 | 204 | 210 | 216 | 222 |
| | Vertical polarization | | | | | | | |
| Peak [dBd] | −26.01 | −25.15 | −25.49 | −25.28 | −25.40 | −26.06 | −27.13 | −26.21 |
| | Horizontal polarization | | | | | | | |
| Peak [dBd] | −10.17 | −8.95 | −8.61 | −7.86 | −7.40 | −7.84 | −8.70 | −9.19 |

TABLE 4

| | Frequency [MHz] | | | | | | | |
|---|---|---|---|---|---|---|---|---|
| | 188.5 | 192.5 | 194.5 | 198 | 204 | 210 | 216 | 222 |
| | Vertical polarization | | | | | | | |
| Peak [dBd] | −26.81 | −26.69 | −26.21 | −26.23 | −26.00 | −25.95 | −26.15 | −25.21 |
| | Horizontal polarization | | | | | | | |
| Peak [dBd] | −10.72 | −9.72 | −9.41 | −8.66 | −7.84 | −7.75 | −7.90 | −7.99 |

Table 5, Table 6, and FIGS. 10(A) and 10(B) show changes of frequency-gain characteristics when no ferrite core is used. Like in FIGS. 9(A) and 9(B), FIG. 10(A) shows a case when the USB cable antenna is not connected to the AC adapter and FIG. 10(B) shows a case when the USB cable antenna is connected to the AC adapter. Comparison of gains near 210 MHz in FIGS. 10(A) and 10(B) shows that while the gain is −26.75 dB in vertical polarization (see Table 5) and −8.15 dB in vertical polarization (see Table 5) when the AC adapter is present, the gain is −23.26 dB in vertical polarization (see Table 6) and −5.66 dB in vertical polarization (see Table 6) when no AC adapter is inserted.

The above results show that when television broadcasting in the VHF band is received, inserting a ferrite core on the side of the USB-A connector is effective in receiving a television signal in the VHF-H band regardless of whether or not an AC adapter is present.

TABLE 5

| | Frequency [MHz] | | | | | | | |
|---|---|---|---|---|---|---|---|---|
| | 188.5 | 192.5 | 194.5 | 198 | 204 | 210 | 216 | 222 |
| | Vertical polarization | | | | | | | |
| Peak [dBd] | −26.81 | −26.45 | −26.21 | −25.43 | −24.49 | −23.26 | −21.63 | −21.61 |
| | Horizontal polarization | | | | | | | |
| Peak [dBd] | −12.47 | −11.52 | −10.93 | −10.06 | −7.77 | −5.66 | −4.10 | −4.75 |

TABLE 6

| | Frequency [MHz] | | | | | | | |
|---|---|---|---|---|---|---|---|---|
| | 188.5 | 192.5 | 194.5 | 198 | 204 | 210 | 216 | 222 |
| | Vertical polarization | | | | | | | |
| Peak [dBd] | −25.81 | −25.65 | −25.77 | −25.73 | −26.15 | −26.75 | −28.75 | −29.37 |
| | Horizontal polarization | | | | | | | |
| Peak [dBd] | −9.67 | −9.09 | −8.81 | −8.48 | −8.20 | −8.15 | −9.33 | −9.24 |

In the foregoing, the USB cable antenna has been described as an embodiment of the present disclosure. A USB cable antenna according to the present disclosure naturally includes, in addition to the embodiment disclosed herein, various application examples and modifications without deviating from the spirit and scope of the present disclosure described in claims.

Additionally, the present technology may also be configured as below.

(1) A USB cable antenna which also uses a USB cable as an antenna that receives a high-frequency signal in a desired band, by connecting a metal shield of the USB cable to an ID terminal of a USB connector connected to the USB cable of a predetermined length connected to an information terminal device, connecting a high-frequency cutoff element having a high impedance for the high-frequency signal in the desired band to both ends of a power supply line and a ground line of the USB cable, and connecting a common mode choke having the high impedance for the high-frequency signal in the desired band to both ends of a transmission line of a differential signal of the USB cable.

(2) The USB cable antenna according to (1), wherein the high-frequency signal in the desired band received by the antenna is a signal of one or a plurality of bands of a FM band, a VHF band, and a UHF band.

(3) The USB cable antenna according to (1) or (2), wherein a resistor to identify a type of the USB cable connected to the ID terminal is connected between an ID line to which the ID terminal is connected and the ground line of the USB cable.

(4) The USB cable antenna according to any one of (1) to (3), wherein the high-frequency cutoff element inserted into the power supply line has the high impedance also when a current flows to the power supply line.

(5) The USB cable antenna according to any one of (1) to (4), wherein a DC resistance of the high-frequency cutoff element inserted into the ground line is 0.25Ω or less.

(6) The USB cable antenna according to any one of (1) to (5), wherein the impedance in the desired band of the common mode choke inserted into both ends of D− and D+ differential signal lines of the USB cable is 90Ω or more.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

REFERENCE SIGNS LIST

21 coaxial shielding wire
10 set-side usb connector
20 cable-side usb-b connector
30 cable-side usb-a connector
11, 13, 26, 33 ferrite bead (fb)
12, 25, 32 common mode choke
24, 31 ferrite bead (fb: for power supply line)

14 capacitor
23 resistor
27 metal shield
40*a*, 40*b*, 50*a*, 50*b*, 60*a*, 60*b* eye pattern
41*a*, 42*a*, 41*b*, 42*b*, 51*a*, 52*a*, 51*b*, 52*b*, 61*a*, 62*a*, 61*b*, 62*b* d− or d+ differential signal
43*a*, 43*b*, 53*a*, 53*b*, 63*a*, 63*b* template

The invention claimed is:

1. A USB cable antenna suitable for acting as both a USB cable and as an antenna for receiving a high-frequency signal in a desired band, the USB cable antenna comprising:

a metal shield connected to an identification (ID) terminal of a cable-side USB connector connectable to an information terminal device;

a high-frequency cutoff elements having a high impedance for the high-frequency signal in the desired band and connected to both ends of a power supply line and a ground line of the USB cable; and common mode chokes having the high impedance for the high-frequency signal in the desired band and connected to both ends of a transmission line of a differential signal of the USB cable.

2. The USB cable antenna according to claim 1, wherein the high-frequency signal in the desired band received by the antenna is a signal of one or a plurality of bands of a FM band, a VHF band, and a UHF band.

3. The USB cable antenna according to claim 2, wherein a resistor to identify a type of the USB cable connected to the ID terminal is connected between an ID line to which the ID terminal is connected and the ground line of the USB cable.

4. The USB cable antenna according to claim 3, wherein the high-frequency cutoff element has the high impedance when a current flows to the power supply line.

5. The USB cable antenna according to claim 4, wherein a DC resistance of the high-frequency cutoff element inserted into the ground line is 0.25Ω or less.

6. The USB cable antenna according to claim 1, wherein the impedance of the common mode choke in the desired band inserted into both ends of D− and D+ differential signal lines of the USB cable is 90Ω or more.

* * * * *